US011581681B2

(12) United States Patent
Nguyen et al.

(10) Patent No.: US 11,581,681 B2
(45) Date of Patent: Feb. 14, 2023

(54) ELECTRONIC PLUG HAVING A LOCKING ASSEMBLY FOR SECURING TO AN ELECTRONIC PORT

(71) Applicant: HEWLETT PACKARD ENTERPRISE DEVELOPMENT LP, Houston, TX (US)

(72) Inventors: Tri Luong Nguyen, Santa Clara, CA (US); Deven Patel, Santa Clara, CA (US)

(73) Assignee: Hewlett Packard Enterprise Development LP, Spring, TX (US)

( * ) Notice: Subject to any disclaimer, the term of this patent is extended or adjusted under 35 U.S.C. 154(b) by 98 days.

(21) Appl. No.: 17/230,215

(22) Filed: Apr. 14, 2021

(65) Prior Publication Data

US 2022/0337002 A1 Oct. 20, 2022

(51) Int. Cl.
*H01R 13/639* (2006.01)
*H01R 13/627* (2006.01)

(52) U.S. Cl.
CPC ..... *H01R 13/639* (2013.01); *H01R 13/6273* (2013.01)

(58) Field of Classification Search
CPC ..... H01R 13/6272; H01R 13/6275; H01R 13/62905; H01R 13/639; H01R 13/6273
USPC ..... 439/352
See application file for complete search history.

(56) References Cited

U.S. PATENT DOCUMENTS

| | | | | |
|---|---|---|---|---|
| 7,402,070 | B1 * | 7/2008 | Wu | H01R 13/6275 439/352 |
| 7,628,636 | B2 * | 12/2009 | Yu | H01R 13/6275 439/372 |
| 7,824,208 | B2 * | 11/2010 | Crofoot | H01R 13/6275 439/352 |
| 8,475,197 | B2 * | 7/2013 | Zerebilov | H01R 13/6275 439/352 |
| 9,362,673 | B1 | 6/2016 | Rinker | |
| 9,644,402 | B1 | 5/2017 | Su | |
| 9,646,179 | B1 | 5/2017 | Munns et al. | |
| 10,522,946 | B1 | 12/2019 | Upadhyaya et al. | |
| 2015/0249304 | A1 * | 9/2015 | Henry | H01R 13/6275 439/372 |

(Continued)

FOREIGN PATENT DOCUMENTS

JP 2011086495 A 4/2011

*Primary Examiner* — Gary F Paumen
(74) *Attorney, Agent, or Firm* — Hewlett Packard Enterprise Patent Department

(57) ABSTRACT

Example implementations relate to an electronic plug having a locking assembly for securing within an electronic port having a receptacle. The locking assembly includes a cantilever beam, a deformable arm, and an axle rotatably coupled to a connector of the electronic plug. The cantilever beam extends from the axle, where a free end of the cantilever beam includes a locking tab aligned to a recess of the connector. The deformable arm extends from the axle, where an open end of the deformable arm is rested on the connector. In a biased state of the deformable arm, the locking tab is positioned below the recess to allow movement of the connector in and out of the receptacle. In a relaxed state of the deformable arm, the locking tab protrudes above the recess to allow movement of the connector into the receptacle and prevent movement of the connector out of the receptacle.

20 Claims, 9 Drawing Sheets

(56) References Cited

U.S. PATENT DOCUMENTS

2017/0110831 A1 4/2017 Su

* cited by examiner

ELECTRONIC PLUG HAVING A LOCKING ASSEMBLY FOR SECURING TO AN ELECTRONIC PORT

BACKGROUND

Computing systems, such as servers, storages, wireless access points or the like may include at least one, and typically, multiple electronic Input-Output (IO) ports, for example, universal serial bus (USB) ports. In such examples, electronic plugs, for example, USB plugs may be connected to the computing system via the USB ports for storing, processing, receiving, or transferring data. Because, the USB plugs are designed to be removable from the USB ports of the computing system in a "plug and play" manner, the USB ports may have a standardized connection interface for the USB plugs, such as mouse, keyboards, scanners, digital cameras, printers, external displays, external storage devices, or the like.

BRIEF DESCRIPTION OF THE DRAWINGS

Various examples will be described below with reference to the following figures.

DETAILED DESCRIPTION

Figure 1A:
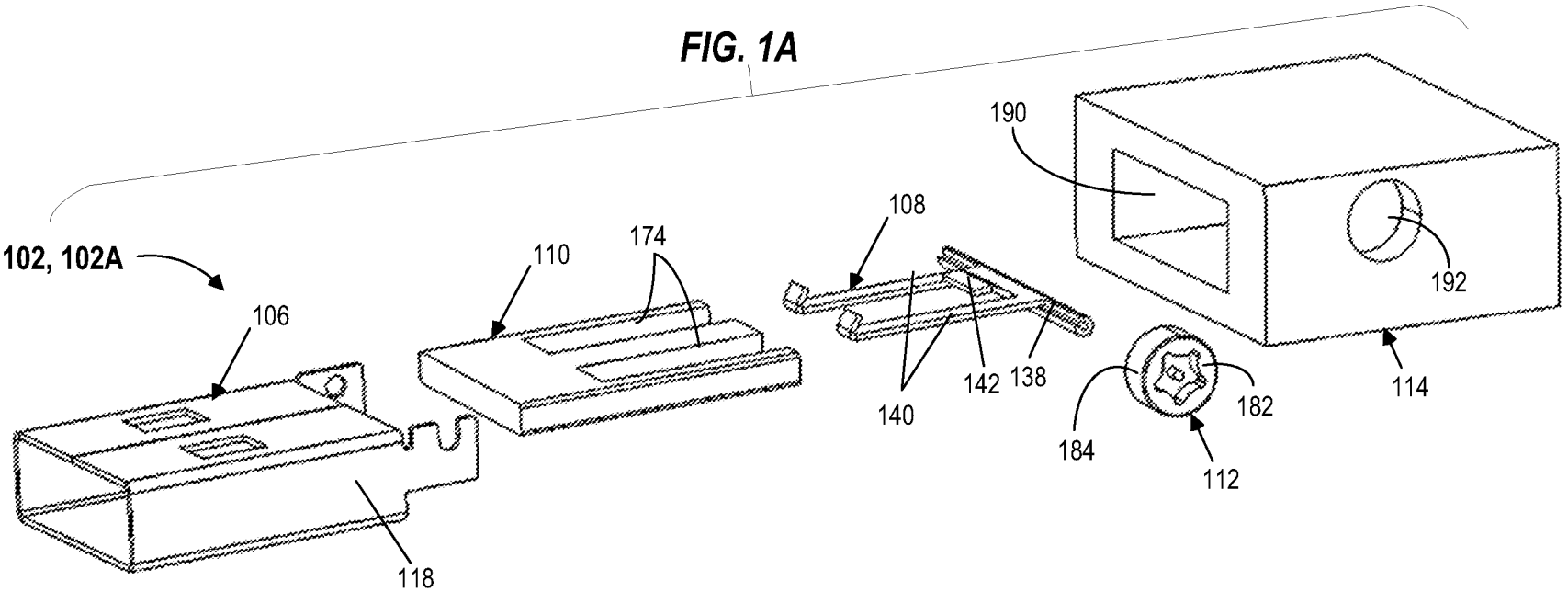
FIG. 1A illustrates an exploded view of an electronic plug of a computing system according to an example implementation of the present disclosure.

The following detailed description refers to the accompanying drawings. Wherever possible, the same reference numbers are used in the drawings and the following description to refer to the same or similar parts. It is to be expressly understood, however, that the drawings are for the purpose of illustration and description only. While several examples are described in this document, modifications, adaptations, and other implementations are possible. Accordingly, the following detailed description does not limit the disclosed examples. Instead, the proper scope of the disclosed examples may be defined by the appended claims.

The terminology used herein is for the purpose of describing example embodiments only and is not intended to be limiting. As used herein, the singular forms "a," "an," and "the" are intended to include the plural forms as well, unless the context clearly indicates otherwise. The term "plurality," as used herein, is defined as two, or more than two. The term "another," as used herein, is defined as at least a second or more. The term "coupled," as used herein, is defined as connected, whether directly without any intervening elements or indirectly with at least one intervening elements, unless otherwise indicated. Two elements may be coupled mechanically, electrically, or communicatively linked through a communication channel, pathway, network, or system. The term "and/or" as used herein refers to and encompasses any and all possible combinations of one or more of the associated listed items. It will also be understood that, although the terms first, second, third, etc. may be used herein to describe various elements, these elements should not be limited by these terms, as these terms are only used to distinguish one element from another unless stated otherwise or the context indicates otherwise. As used herein, the term "includes" means includes but not limited to, the term "including" means including but not limited to. The term "based on" means based at least in part on.

As used herein, the term "computing system" may refer to a compute infrastructure, such as an access point (AP), a server system, a storage system, a power conversion system, a communication system, or a networking system, having an electronic port for receiving an electronic plug. As used herein the term "access point" may refer to a type of the computing system, which creates a wireless local area network (WLAN) by i) connecting to networking devices, such as a router, switch, or hub via an Ethernet cable, and ii) projecting a Wi-Fi signal to a designated area. As used herein, the term "electronic port" may refer to any one type of a port having a receptacle (or a socket), which is native to the computing system, or which is integral to the computing system, and may provision a connector of the electronic plug to be detachably connected to the electronic port. As used herein, the term "electronic plug" may refer to any one type of a plug having the connector, which is not native to the computing system, or which is ancillary to the computing system, and may have to be connected by way of fitting or plugging into the receptacle of the electronic port for storing, transmitting, receiving, or processing of data or the like. As used herein, the term "free end" or "open end" may refer an end portion of an object that is not coupled (or fixed or joined) to another object, and the end portion that is mounted (or seated) on the other object or aligned with the other object. As used herein, the term "bend down" may refer to deflecting the object downwards to a curved position relative to a fixed end portion of the object. The term "straighten up" may refer to deflecting the object upwards to a linear position relative to the fixed end portion. As used herein, the term "below a recess" or "above the recess" may refer to a movement of the free end of the object along a direction, which is substantially perpendicular to the direction of movement of the electronic plug for coupling to the electronic port. As used herein the term "above the recess" may also refer to protruding the free end of the object outside a surface of the component having the recess, from a hollow space of the component. For example, the term "above the recess" may refer to protruding a locking tab outside a surface of a connector and/or a receptacle having the recess, from the hollow space of the connector and/or the receptacle. Similarly, as used herein the term "below the recess" may refer to positioning the free end of the object underneath the surface (inside the hollow space) of the component having the recess. For example, the term "below the recess" may refer to positioning the locking tab underneath the surface (inside the hollow space) of the connector and/or the receptacle having the recess. As used herein, the term "plugging-in" may refer to movement of the connector into the receptacle for connecting the electronic plug physically into the electronic port of the computing system. As used herein, the term "plugging-out" may refer to movement of the connector out of the receptacle for removing the electronic plug physically from the electronic port of the computing system. As used herein, the term "deformable arm" may refer to an elastic object that may deform (or expand or stretch) on application of a load (force) and may retain its original shape on removal of the load. The term "relaxed state" may refer to a free condition or a normal condition of the elastic object, where the object is in its original shape or the object has returned to its original shape on removal of the load. The term "biased state" may refer to a loaded condition of the elastic object, where the object has deformed (expanded or stretched) on application of the load. As used herein the term "unitary component" may refer to a single or one-piece component. For example, the term "unitary locking component" may refer to a locking component that is formed (or manufactured) by merging or integrating two or more discrete elements, for example, an axle, a cantilever beam, and a deformable arm, of the locking assembly.

The present disclosure describes example implementations of an electronic plug having a locking assembly to secure within an electronic port of a computing system. The electronic plug may include a connector having a first recess. In some examples, the locking assembly may include an axle, a cantilever beam, and a deformable arm. The axle may be rotatably coupled to the connector, and the cantilever beam may extend from the axle, where a free end of the cantilever beam may include a locking tab aligned with the first recess. The deformable arm may extend from the axle, where an open end of the deformable arm is rested on the connector. In a biased state of the deformable arm, the locking tab is positioned below the recess to allow movement of the connector in and out of the receptacle. In a relaxed state of the deformable arm, the locking tab protrudes above the recess to allow movement of the connector into the receptacle and prevent movement of the connector out of the receptacle.

For purposes of explanation, certain examples are described with reference to the components illustrated in FIGS. 1-16. The functionality of the illustrated components may overlap, however, and may be present in a fewer or greater number of elements and components. Further, all or part of the functionality of illustrated elements may co-exist or be distributed among several geographically dispersed locations. Moreover, the disclosed examples may be implemented in various environments and are not limited to the illustrated examples. Further, the sequence of operations performed for locking (securing) the electronic plug within the electronic port described in connection with FIGS. 8-10 and 16, is an example and is not intended to be limiting. Additional or fewer operations or combinations of operations may be used or may vary without departing from the scope of the disclosed examples. Thus, the present disclosure merely sets forth possible examples of implementations, and many variations and modifications may be made to the described examples. Such modifications and variations are intended to be included within the scope of this disclosure and protected by the following claims.

An electronic plug, such as a universal serial bus (USB) plug functioning as at least one of a mobile network modem (4G/5G modems), a ZigBee dongle, or a Bluetooth dongle may be used in a computing system, such as an access point (remote access point or instant access point), a controller, a gateway connected to network devices via Ethernet cable. Examples of the network device may include, but are not limited to, switches, routers, hubs, or the like. Typically, the access point has an electronic port, such as a USB port for providing connectivity with the USB plug. In such examples, the USB plug may be easily added to the access point by way of plugging it into the USB port. However, removing the USB plug from the USB port may be as easy as it is added into the USB port, thus making the USB plug an easy target for unauthorized removal and theft from the access point. Some previous approaches to secure the USB plug included using an external locking mechanism to secure the USB plug within the access point. However, the external locking mechanism may include a separate connection point on the computing system, to which the USB plug is coupled to in order to lock the USB plug to the computing system. Thus, the external locking mechanism may complicate connection of the USB plug to the computing device, and also complicate an authorized removal of the USB plug from the access point. Additionally, a data center, for example, may include several USB plugs in close proximity to one another, thus using the external locking mechanism for securing each of the several USB plugs may become complicated and tedious process. Further, the external locking mechanism are typically bulky in nature, thus making it difficult to use in the access point having space constraints. Thus, overall the usage of the external locking mechanism to secure the USB plug to the access point may be cumbersome or may not be cost effective.

A technical solution to the aforementioned problems include providing a locking assembly (or a security assembly) within an electronic plug, such as a USB plug to prevent unauthorized removal of the USB plug from an electronic port, such as a USB port, when the USB plug is plugged into a computing system, such as an access point. In other words, the locking assembly includes components, which are internal to the USB plug, which occupies a substantially little space due to its integration with one or more standardized components of the USB plugs, and which may have a complementary design to that of standardized components of the USB port, and which are of a miniaturized nature in design. Accordingly, the locking assembly having a simple design may allow the cost to be substantially low. Thus, the locking assembly disclosed herein is self-contained and does not use additional components external to the USB plug.

In some examples, the electronic plug, for example, the USB plug may include a connector having a first recess, and a locking mechanism having an axle, a cantilever beam, and a deformable arm. The connector may be a standardized component of the USB port, whereas the axle, the cantilever beam, and the deformable arm are internal components of the USB plug, which may collectively work in tandem to function as the locking assembly of the USB plug. In some examples, the axle may be rotatably coupled to the connector, and whereas the cantilever beam and the deformable arm may be spaced apart from each other and extend from the axle. Further, the cantilever beam may include a locking tab located at its free end, where the locking tab may be aligned with the first recess. The deformable arm may include an open end, which is rested on the connector. In one or more examples, the deformable arm in a biased state (expanded or stretched) may position the locking tab below the first recess to allow movement of the connector in and out of a receptacle of an electronic port. Similarly, the deformable arm in a relaxed state (normal condition or free condition) may protrude the locking tab above the first recess to allow movement of the connector into the receptacle and prevent movement of the connector out of the receptacle.

In some examples, the axle may be transferred to a loaded position by rotating the axle along a first direction, which may result in bending down the cantilever beam and moving the deformable arm into the biased state, so as to position the locking tab below the first recess to allow movement of the connector in and out of the receptacle. Similarly, the axle may be transferred to a unloaded position by rotating the axle along a second direction opposite to the first direction, which may result in straightening up of the cantilever beam and moving the deformable arm into the relaxed state, so as to protrude the locking tab above the first and second recesses to prevent movement of the connector out of the receptacle.

The electronic plug may include an insulator disposed within the connector and coupled to at least one inner surface of the connector. In such examples, the insulator may have an elongated opening to allow the cantilever beam to bend down, straighten up, and extend from the axle, and the locking tab to protrude above and position below the first recess and/or the second recess. In one or more examples, the axle, the cantilever arm, and the deformable arm may be integrated to one another to form a unitary locking component.

Figure 1B:
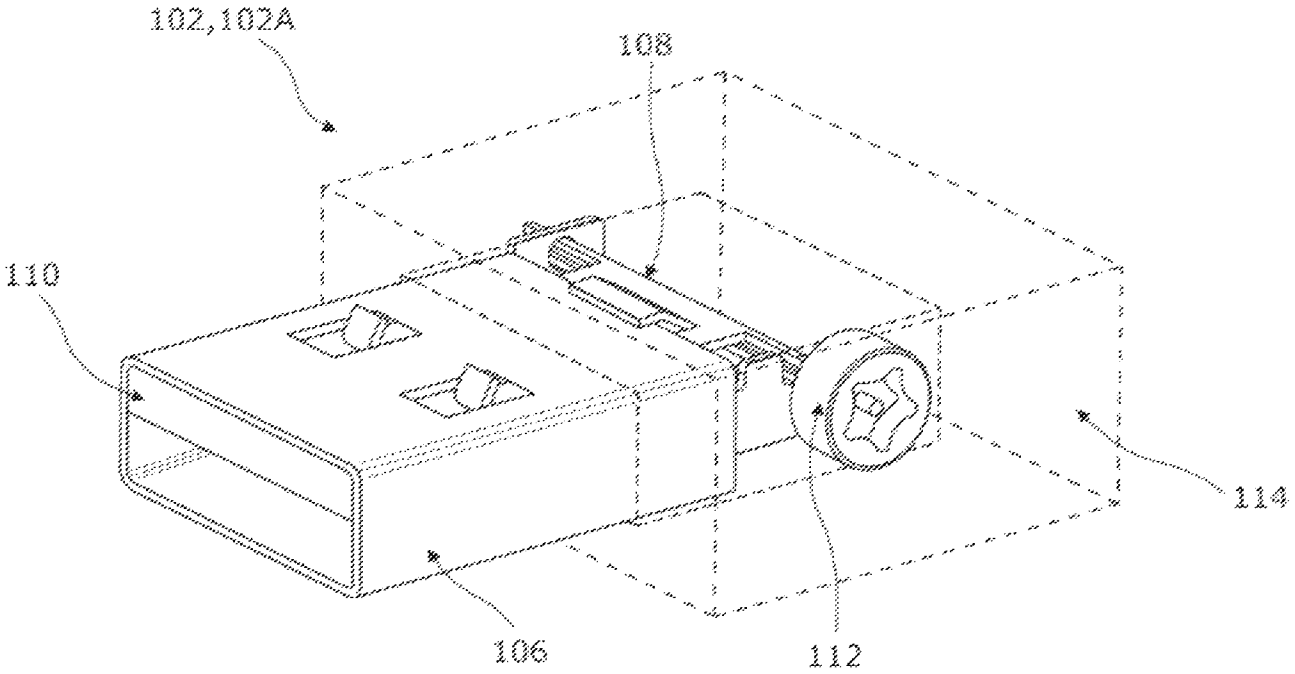
FIG. 1B illustrates an assembled view of the electronic plug of FIG. 1A according to the example implementation of the present disclosure.
Figure 8:
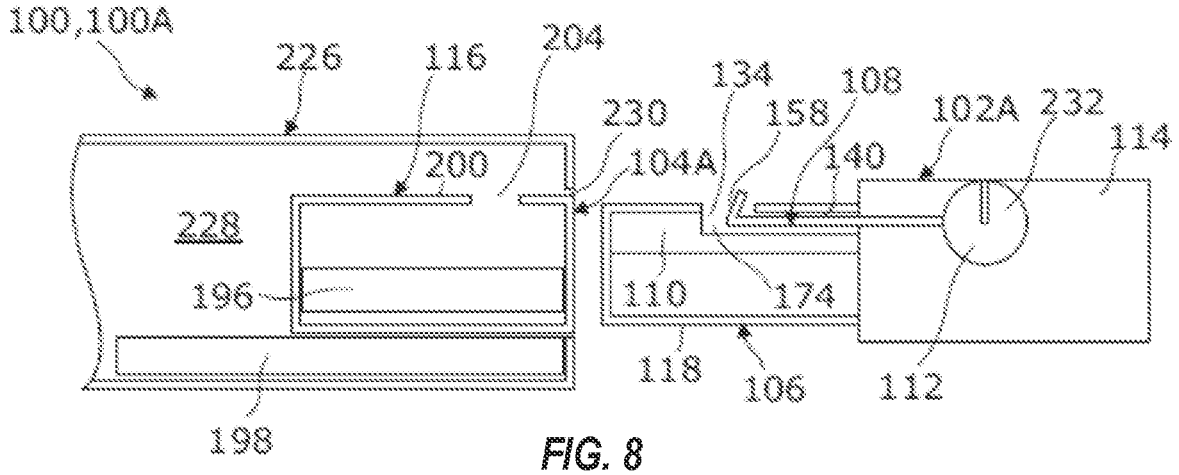
FIG. 8 is a block diagram representing a cross section view of a portion of a computing system having an electronic plug of FIGS. 1A, 1B, and 2-6, an electronic port of FIG. 7, and an enclosure according to an example implementation of the present disclosure.

FIG. 1A depicts an exploded view of an electronic plug 102 of a computing system 100 (shown in FIG. 8). FIG. 1B depicts an assembled view of the electronic plug 102. In some examples, the electronic plug 102 is a universal serial bus (USB) plug 102A, which may function as a mobile network modem (4G/5G modem), a ZigBee dongle, a Bluetooth dongle, or the like, without deviating from the scope of the present disclosure. For example, when the USB plug 102A is a 4G/5G modem, it may function as a cellular device that may provide backhaul or primary connection to a core network. In some other non-limiting examples, the USB plug 102A may function as a peripheral device, such as mouse, keyboard, scanner, digital camera, printer, external display, external storage device, or the like. In one or more examples, the USB plug 102A includes a connector 106, a locking assembly 108, an insulator 110, an actuator 112, and a plug body 114. It may be noted herein that the plug body 114 is shown as a transparent structure in the example of FIG. 1B so as to depict assembled components of the electronic plug 102, such as the connector 106, the insulator 110, and the locking assembly 108 and such an illustration should not be construed as a limitation of the present disclosure.

Figures 2, 3:
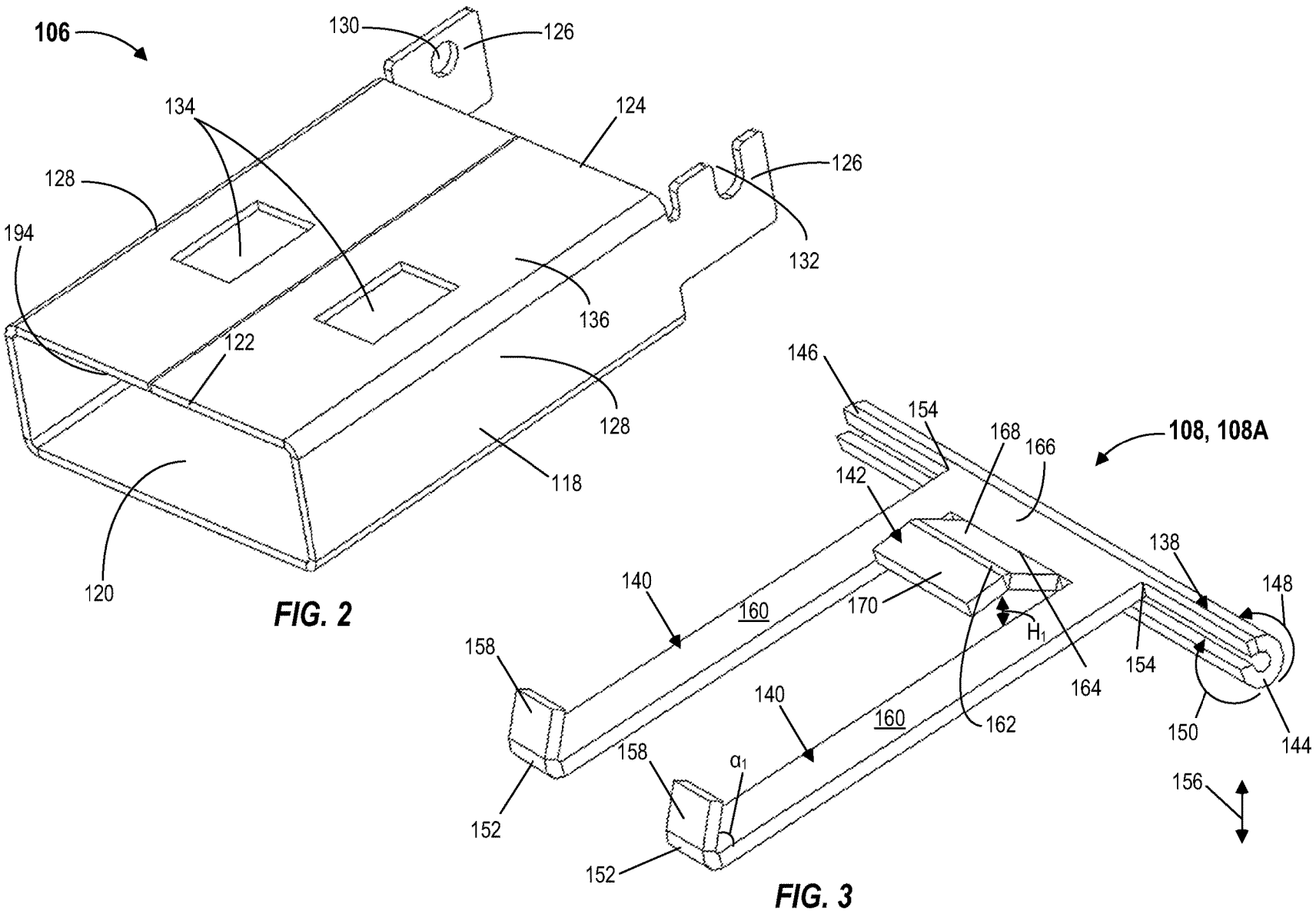
FIG. 2 illustrates an isometric view of a connector of the electronic plug of FIGS. 1A and 1B according to the example implementation of the present disclosure.
FIG. 3 illustrates an isometric view of a locking assembly of the electronic plug of FIGS. 1A and 1B according to the example implementation of the present disclosure.

The connector 106 may refer to a portion of the USB plug 102A, which may be get plugged into (connected to) a receptacle 116 of an electronic port 104 (shown in FIG. 7), for example, a USB port 104A for detachably coupling the USB plug 102A to the computing system 100. In some examples, the connector 106 may be a USB connector. For example, as illustrated in FIG. 1A, the connector 106 is a USB Type A connector. In one or more examples, the connector 106 may be a standardized component of the USB plug 102A. Referring to FIGS. 1A, 1B, and 2, the connector 106 has a shell 118, and a plurality of conductors (not shown) disposed within the shell 118 and connected to circuitry (not shown) disposed within the plug body 114. The plurality of conductors of the USB plug 102A may be configured to interface/connect with a plurality of conductors disposed in the receptacle 116, when the USB plug 102A is detachably coupled to the computing system 100. In some examples, the shell 118 may be a hollow component having a bore 120 extending between a first end 122 and a second end 124 of the shell 118. Further, the shell 118 may include a pair of flanges 126 spaced apart from each other and coupled to the second end 124 of the shell 118. In other words, the pair of flanges 126 may extend from a pair of peripheral side walls 128 of the shell 118 at the second end 124 of the shell 118. In some examples, one flange of the pair of flanges 126 has a through-opening 130 and another flange of the pair of flanges 126 has an open channel 132. Further, the shell 118 has a pair of first recesses 134, which are spaced apart from one another and formed on a cover 136 of the shell 118, as per the standard specifications of the USB plug 102A. In one or more examples, the shell 118 may be inserted into a hollow space 212 (shown in FIG. 7) of the receptacle 116, when the USB plug 102A is plugged into the USB port 104A.

In some examples, the locking assembly 108 includes components, which may collectively work in tandem to prevent plugging-out of the USB plug 102A from the USB port 104A, to permit plugging-out of the USB plug 102A from the USB port 104A, or to permit plugging-in of the USB plug 102A into the USB port 104A. Referring to FIGS. 1A, 1B, and 3, the locking assembly 108 includes an axle 138, a pair of cantilever beams 140, and a deformable arm 142. In the example of FIG. 3, the axle 138, the pair of cantilever beams 140, and the deformable arm 142 are integrated or merged to one another to form a unitary locking component 108A. In some other examples, the axle 138, the pair of cantilever beams 140, and the deformable arm 142 are discrete components, which may be coupled to one another using known coupling mechanism, depending on a type of materials being used for manufacturing such components.

The axle 138 may be a rigid bar having a first end 144 and a second end 146, which are configured to be supported on a pair of support elements, for example, the pair of flanges 126 in the connector 106, to allow the axle 138 to rotate along a first direction 148 and a second direction 150. In some examples, a plurality of splines (not shown) may be formed on an outer surface of the axle 138, to allow another object, such as the actuator 112 having a plurality of complementary splines to be press-fitted to the axle 138.

In the illustrated example, the locking assembly 108 has the pair of cantilever beams 140. However, in some other implementations, the locking assembly 108 may include a single cantilever beam, or may have more than two cantilever beams. In some examples, each cantilever beam 140 extends from the axle 138. In one or more examples, each cantilever beam 140 is a rigid member having a free end 152 projecting beyond a point of support 154, and free to move along a vertical plane 156 under the influence of loads placed at the point of support 154 or between the free end 152 and the point of support 154. In some examples, the point of support 154 (or fixed end) is formed at an interface between the axle 138 and each cantilever beam 140. In one or more examples, the free end 152 of each cantilever beam 140 has a locking tab 158. In some examples, the locking tab 158 is oriented at an acute angle "$\alpha_1$" relative to a respective cantilever beam 140, for example, a body 160 of the respective cantilever beam 140 so as to allow easy plugging-in of the connector 106 of the USB plug 102A into the receptacle 116 of the USB port 104A.

The deformable arm 142 is an elastic member, which extends from the axle 138. In some examples, the deformable arm 142 is a leaf spring having an open end 162 projecting beyond a point of support 164 (or fixed end). In some examples, the point of support 164 is formed at an interface between the axle 138 and the deformable arm 142 through a support member 166. In one or more examples, the deformable arm 142 includes a supporting arm 168 extending from the point of support 164, and a resting arm 170 extending from the supporting arm 168. In such examples, the supporting arm 170 may be an elastic member, which may be inclined at an angle relative to the support member 166, and which may get deformed (expanded or stretched) under the influence of loads placed at the point of support 164. In one or more examples, the open end 162 of the deformable arm 142, and the body 160 of each cantilever beam 140 are maintained at a height "$H_1$" in order to allow the movement of the deformable arm 142 to a biased state or a relaxed state.

Figure 4:
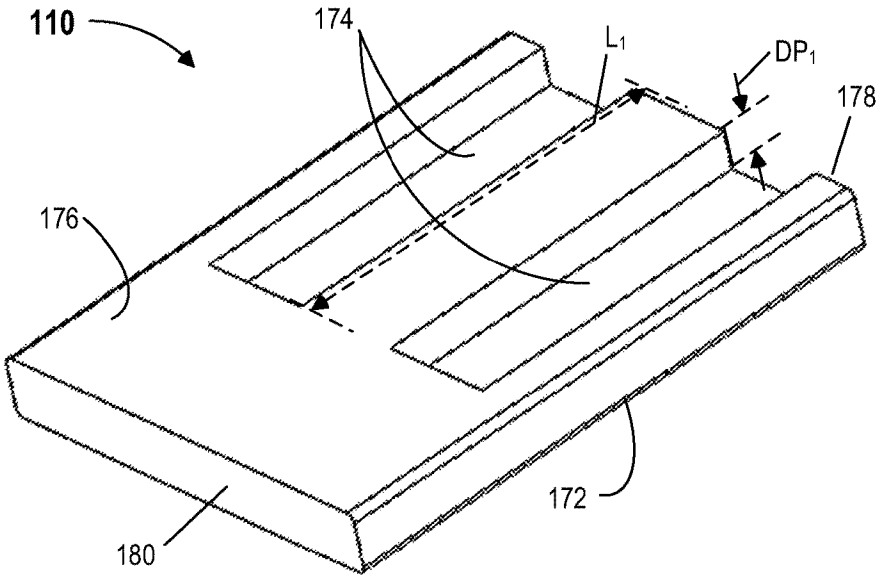
FIG. 4 illustrates an isometric view of an insulator of the electronic plug of FIGS. 1A and 1B according to the example implementation of the present disclosure.
Figure 7:
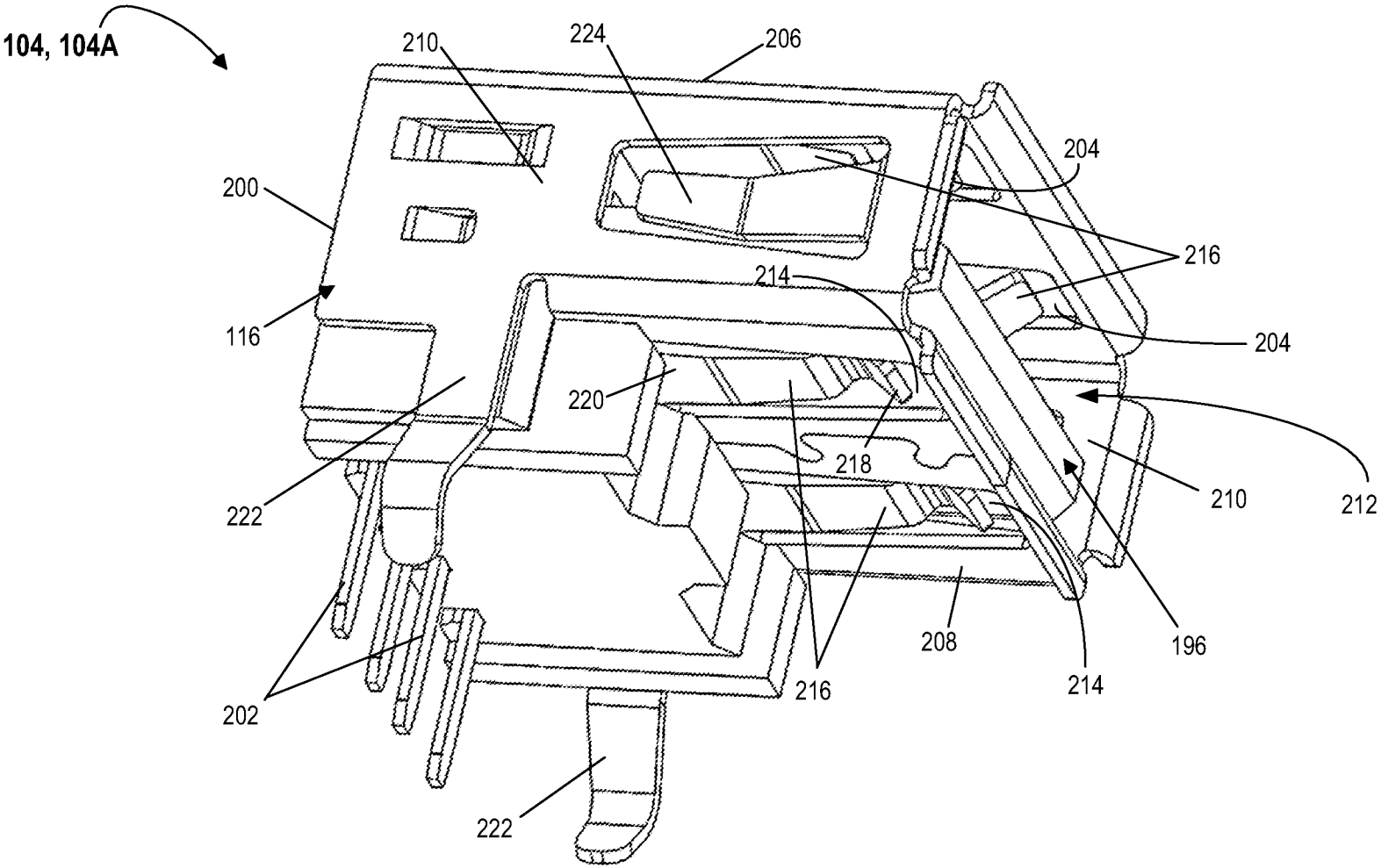
FIG. 7 illustrates an isometric view of an electronic port of a computing system according to an example implementation of the present disclosure.

The insulator 110 may electrically shield the plurality of conductors (not shown) extending from the plug body 114 of the USB plug 102A. In such examples, the insulator 110 may have channels (not shown) formed along a bottom surface 172 of the insulator to hold the plurality of conductors in place, without contacting the connector 106. Referring to FIGS. 1A, 1B, and 4, the insulator 110 may further include a pair of elongated openings 174 formed on an upper surface 176 of the insulator 110. For example, the pair of elongated openings 174 are spaced apart from each other, and may extend to a pre-defined length "$L_1$" from a first end 178 towards a second end 180 of the insulator 110. In some examples, the pre-defined length "$L_1$" may be substantially greater than a length of a corresponding cantilever beam 140. Similarly, each opening of the pair of elongated openings 174 may have a pre-defined depth "$DP_1$", which is substantially greater than a thickness of the corresponding cantilever beam 140. In one or more examples, the elongated opening having the pre-defined depth $DP_1$ may allow the pair of cantilever beams 140 to bend down, straighten up, and extend from the axle 138, and the pair of locking tabs 158 to protrude above and position below the pair of first recesses 134 (and/or a pair of second recesses 204, as shown in FIG. 7). In some examples, the number of the elongated openings 174 may depends on the number of cantilever beams 140.

Figure 5:
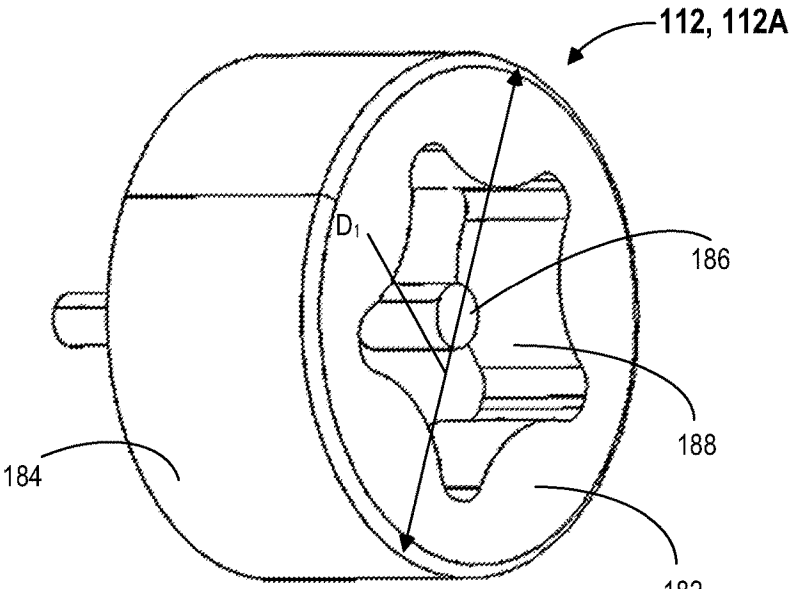
FIG. 5 illustrates an isometric view of an actuator of the electronic plug of FIGS. 1A and 1B according to the example implementation of the present disclosure.

The actuator 112 may also form a part of the locking assembly 108. In some examples, the actuator 112 may be a mechanism that may be transitioned from a first position to a second position, and from the second position to the first position in order to rotate the axle 138 along the first direction 148 and second direction 150 (shown in FIG. 3). In some examples, the actuator 112 may be mechanical, electrical, or electromechanical. Examples of a mechanical actuator may include, but are not limited to, a knob, a rack and pinion, or the like. A non-limiting example of an electrical actuator may be a piezoelectric actuator (e.g., a bimorph), or the like. Similarly, examples of an electromechanical actuator may include, but are not limited to, a solenoid and an electric motor, or the like. Referring to FIGS. 1A, 1B, and 5, the actuator 112 is a knob 112A. In such examples, the knob 112A includes a knob head 182, a knob body 184 connected to the knob head 182, and a spindle 186 extending through the knob head 182 and the knob body 184. The knob head 182 has a unique shaped groove head 188. For example, in the illustrated example of FIG. 5, the unique shaped groove head 188 is a Torx shaped groove head, for example, a Torx T8H shaped groove head. The knob body 184 having a first diameter "$D_1$", encompasses the knob head 182. The spindle 186 may have a plurality of complementary spines (not shown) to that of the plurality of splines of the axle 138, so as to allow the knob 112A to be press-fitted to the axle 138.

Figure 6:
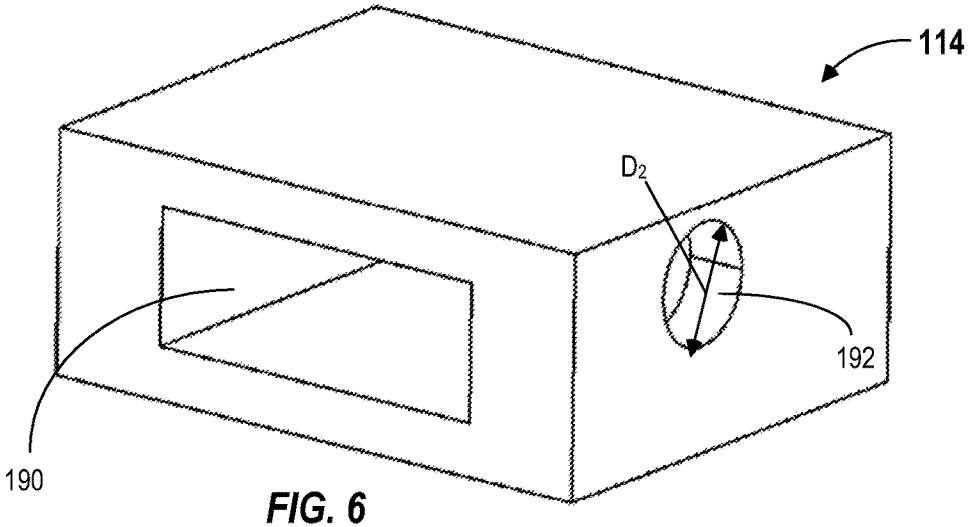
FIG. 6 illustrates an isometric view of a plug body of the electronic plug of FIGS. 1A and 1B according to the example implementation of the present disclosure.

The plug body 114 may refer to another portion of the USB plug 102A, which may be coupled to the connector 106 to define the USB plug 102A. In some examples, the plug body 114 may include circuitry (not shown) for operation of the USB plug 102A and a plurality of conductors (not shown) to establish connection between the circuitry and a plurality of the conductors (not shown) of the USB port 104A. In some examples, if the USB plug 102A is a mobile network modem, then the plug body 114 may include circuitry for receipt and transmission of data over a mobile network. In some other examples, if the USB plug 102A is an external storage device, for example, a pen-drive, then the plug body 114 may include circuitry for storage of data. Referring to FIGS. 1A, 1B, and 6, the plug body 114 is a box shaped component having an internal chamber 190 formed along a front portion of the plug body 114. The internal chamber 190 may house a portion of the connector 106, the locking assembly 108, and the insulator 110. Further, the plug body 114 may include one or more fasteners (not shown) for coupling the plug body 114 to the connector 106. In some examples, the plug body 114 further includes a first hole 192 formed on at least one peripheral wall of the plug body 114. The first hole 192 has a second diameter "$D_2$". In some examples, the first diameter "$D_1$" of the knob body 184 may be substantially equal to the second diameter "$D_2$" of the plug body 114.

Referring to FIGS. 1A, 1B, and 2-6, the insulator 110 is first coupled to the connector 106. For example, the insulator 110 is disposed within the bore 120 of the connector 106, and the upper surface 176 of the insulator 110 is coupled to an inner surface 194 of the connector 106 such that a portion the pair of elongated openings 174 is accessible/visible from the pair of first recesses 134. Later, the locking assembly 108 having the axle 138, the pair of cantilever beams 140, and the deformable arm 142 is assembled into the connector 106 having the insulator 110. For example, the pair of cantilever beams 140 is inserted along the pair of elongated openings 174 in the insulator 110 such that the pair of locking tabs 158 is aligned with the pair of first recesses 134, and the resting arm 170 of the deformable arm 142 is rested on the cover 136 of the connector 106. Later, the second end 146 of the axle 138 is inserted into the through-opening 130 of the connector 106, and the first end 144 of the axle 138 is plugged into the open channel 132 in the connector 106. Thus, the axle 138 is rotatably coupled to the connector 106 to rotate along the first and/or second directions 148, 150 respectively. In the illustrated example, the first direction 148 corresponds to movement along a counter clockwise direction and the second direction 150 corresponds to movement along a clockwise direction. In such examples, the deformable arm 142 in the relaxed state may allow the pair of locking tabs 158 to protrude above the pair of first recesses 134. Further, the internal chamber 190 of the plug body 114 may house the portion of the connector 106 having the insulator 110, and the portion of the locking assembly 108 such that the first hole 192 in the plug body 114 is aligned with the first end 144 of the axle 138. The plug body 114 is later coupled to the connector 106. Finally, the actuator 112 is disposed within the first hole 192 of the plug body 114 such that the spindle 186 of the plug body 114 gets coupled (press-fitted) to the first end 144 of the axle 138. Accordingly, the USB plug 102A having the portion of the locking assembly 108 disposed within the plug body 114 and coupled to the connector 106 and the plug body 114, as depicted in FIG. 1B gets assembled.

FIG. 7 depicts an isometric view of an electronic port 104 of a computing system 100 (shown in FIG. 8). In one or more examples, the electronic port 104 may a universal serial bus (USB) port 104A. In some examples, the USB port 104A may have a standard cable connection interface to connect with i) networking devices (not shown), such as switches, routers, or hubs, and ii) the USB plug 102A. In such examples, the USB port 104A may allow the USB plug 102A to be connected to it, in order to receive, transmit, and process digital data. In some other examples, the USB port 104A may also be configured to supply electric power to one or more devices (not shown) via the USB plug 102A. In the illustrated example of FIG. 7, the USB port 104A includes a receptacle 116, an insulator 196, and a circuit board 198 (as shown in FIG. 8).

The receptacle 116 may be a standardized component of the USB port 104A, for a short-distance digital data communications and transmissions. The receptacle 116 has a shell 200 and a plurality of conductors 202 configured to interface/connect with the plurality of conductors of the USB plug 102A and the circuit board 198. In some examples, the shell 200 includes a cover 206, a base 208, and a pair of peripheral walls 210, which are coupled to one another to define a hollow space 212 there between for receiving the connector 106 of the USB plug 102A. In such examples, the insulator 196 may be disposed within the hollow space 212 of the shell 200. The insulator 196 may have channels (not shown) formed along a bottom surface of the insulator 196 to hold the plurality of conductors 202 in place, without contacting the receptacle 116. The plurality of the conductors 202 may further extend from the channels to connect with the circuit board 198 (shown in FIG. 8). In such examples, the plurality of conductors 202 may interface with the plurality of conductors of the USB plug 102A. In one or more examples, the cover 206 has a pair of second recesses 204, and the base 208 has a pair of third recesses 214. As discussed herein, recesses in the pair of second recesses 204 and the recesses in the pair of third recesses 214 are spaced apart from each other at a pre-defined distance, which is as per the standard specifications of the USB port 104A. In such examples, the receptacle 116 may further include a plurality of retainers 216 formed around the plurality of second and third recesses 204, 214 respectively, on the cover 206 and the base 208, such that each of the plurality of retainers 216 has cantilevered structure including a freely suspended portion 218 and a fixed portion 220. The receptacle 116 may further include a pair of support elements 222 and a peripheral support mechanism 224 in order to provide support to the receptacle 116 within an enclosure 226 (shown in FIG. 8) of the computing system 100. The circuit board 198 may receive the digital data from the USB plug 102A through the plurality of conductors 202, process the received data, and transmit the processed data to the networking devices.

FIG. 8 is a block diagram depicting a cross section view of a portion of a computing system 100 having an electronic plug 102 of FIGS. 1A, 1B, and 2-6, an electronic port 104 of FIG. 7, and an enclosure 226. Examples of computing system 100 may include, but are not limited to, desktop computers, laptop computers, tablet computers, mobile devices, routers, access points, servers, or the like. Although implementations illustrated and discussed herein include the USB plug 102A and the USB port 104A, the implementations of the present disclosure are not so limited to only these type of electronic plug 102 and electronic port 104, respectively.

In the illustrated example of FIG. 8, the computing system 100 is the access point 100A, which may be configured to create a wireless local area network (WLAN) by i) connecting the access point 100A to networking devices (not shown), such as a router, a switch, or a hub via an Ethernet cable, and ii) projecting a Wi-Fi signal to a designated area. The access point 100A includes the enclosure 226 having the USB port 104A disposed within the enclosure 226. Further, a receptacle 116 of the USB port 104A may receive a connector 106 of the USB plug 102A, when it is plugged (i.e., detachably coupled) to the USB port 104A.

The enclosure 226 may be box like component, which may be disposed at a distant location to that of the networking devices, and may be physically coupled to a support structure (not shown). In one or more examples, the enclosure 226 is formed by a cover, a base, and a plurality of peripheral walls, which are coupled to one another to define a hollow region 228 there between. In such examples, one peripheral wall may include a cut-out 230 to provide access to the USB port 104A, which is disposed within the hollow region 228 of the enclosure 226. The cut-out 230 may have a design feature, which is complementary to that of the connector 106 of the electronic plug 102.

The electronic plug 102 may be a universal serial bus (USB) plug 102A. As discussed herein, the connector 106 having an insulator 110, and a plug body 114 may collectively define the USB plug 102A of the present disclosure. In such examples, the USB plug 102A may further include a locking assembly 108 disposed partially in the plug body 114 for securing the USB plug 102A within the USB port 104A or preventing unauthorized removal (plugging-out) of the USB plug 102A from the USB port 104A. As discussed herein, the connector 106 includes a shell 118 having a first recess 134, and the insulator 110 includes an elongated opening 174. Further, the locking assembly 108 includes an axle 138, a cantilever beam 140, and a deformable arm 142.

It may be noted herein that the axle 138 and the deformable arm 142 are not depicted in the example of FIG. 8, as those components are covered by the plug body 114, and such an illustration should not be construed as a limitation of the present disclosure. As discussed herein, the axle 138 is rotatably coupled to the connector 106. The cantilever beam 140 extends from the axle 138, where a free end 152 (as labeled in FIG. 3) of the cantilever beam 140 includes a locking tab 158 aligned with the first recess 134. Further, the deformable arm 142 extends from the axle 138, where an open end 162 (as labeled in FIG. 3) of the deformable arm 142 is rested on the connector 106. The plug body 114 houses a portion of the locking assembly 108 and the connector 106. Further, the actuator 112 is disposed within a first hole 192 (as labeled in FIG. 6) of the plug body 114 and coupled to the axle 138. In the example of FIG. 8, the deformable arm 142 holds the locking tab 158 to protrude above the first recess 134 in a relaxed state. In such examples, the actuator 112 is held in a second position 232. It may be noted herein that the second position 232 may be representative of a locked stage of the USB plug 102A.

The electronic port 104 may be the USB port 104A. As discussed herein, the USB port 104A may receive the USB plug 102A and establish a connection there between, in order to receive, transmit, and process the digital data, or supply electric power to one or more devices (not shown) through the USB plug 102A. As discussed herein, the USB port 104A may include the receptacle 116, an insulator 196, and a circuit board 198. The receptacle 116 may be an industry standard receptacle/socket for a short-distance digital data communications and transmissions. The receptacle 116 is disposed within the hollow region 228 of the enclosure 226, facing the cut-out 230. In such examples, the receptacle 116 include a shell 200 having a second recess 204. The insulator 196 is disposed within the shell 200, and the circuit board 198 is disposed within the hollow region 228 of the enclosure 226.

Figure 9:
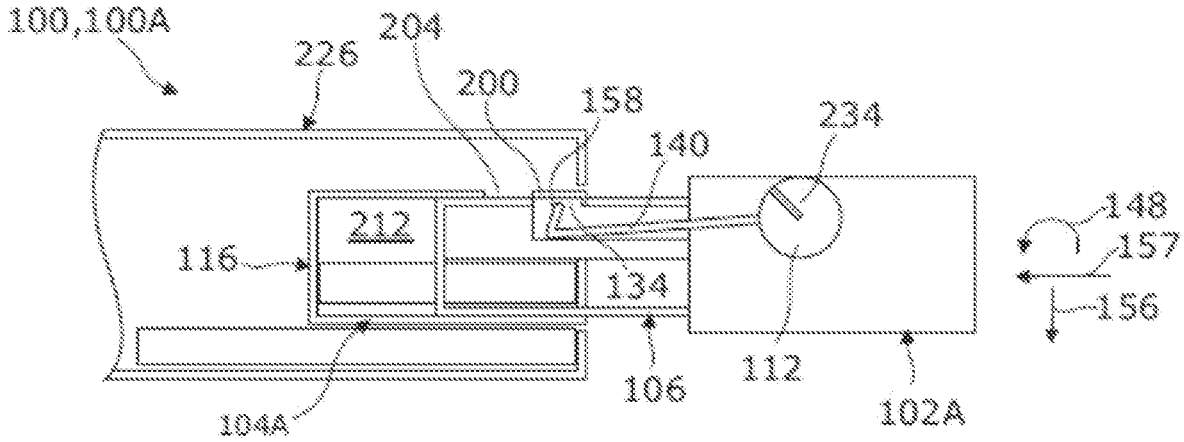
FIG. 9 is a block diagram representing a cross section view of the portion of the computing system of FIG. 8, having the electronic port receiving the electronic plug according to the example implementation of the present disclosure.

FIG. 9 is a block diagram depicting a cross section view of the portion of the computing system 100 of FIG. 8, having the electronic port 104 receiving the electronic plug 102. In some examples, the electronic plug 102, for example, the USB plug 102A is plugged to the electronic port 104, for example, the USB port 104A via the cut-out 230 (labeled in FIG. 8) in the enclosure 226. For example, the USB plug 102A is plugged to the USB port 104A, by slidably inserting the connector 106 along a horizontal plane 157 into the receptacle 116. As the connector 106 passes through the hollow space 212 of the receptacle 116, the locking tab 158, which is protruded above the first recess 134 contacts the shell 200 of the receptacle 116. In such example, further insertion of the connector 106 into the receptacle 116, causes the locking tab 158 (which is oriented at the acute angle "$\alpha_1$" relative to the cantilever beam 140) to deflect, and bend the cantilever beam 140 downwards along the vertical plane 156, in order to position the locking tab 158 below the first recess 134. Thus, allowing the movement of the connector 106 into the receptacle 116. In one or more examples, bending down of the cantilever beam 140 causes the deformable arm 142 to move to a biased state, and the axle 138 to rotate along a first direction 148, thus resulting in transitioning the actuator 112 to a first position 234. It may be noted herein that the first position 234 may be representative of an unlocked stage of the USB plug 102A.

Figure 10:
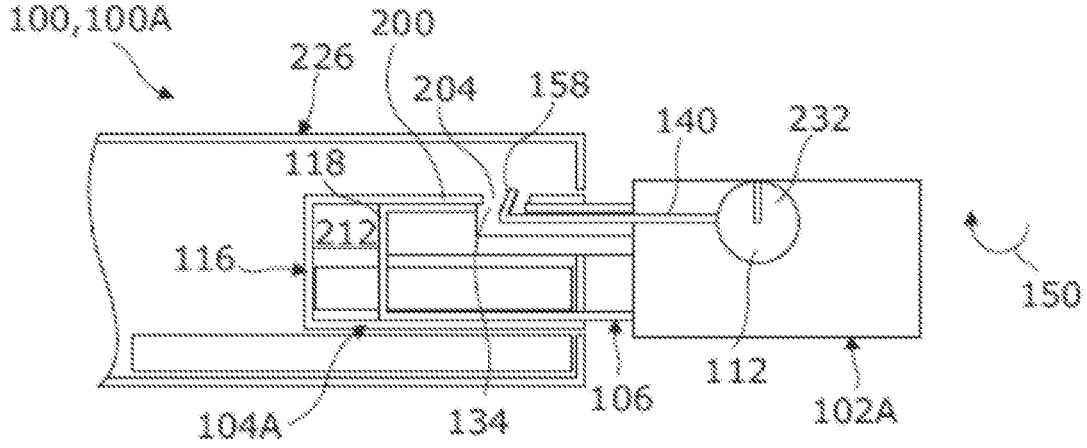
FIG. 10 is a block diagram representing a cross section view of the portion of the computing system of FIGS. 8 and/or 9, having the electronic plug connected to the electronic port and retained in a locked stage within the electronic port according to the example implementation of the present disclosure.

FIG. 10 is a block diagram depicting a cross section view of the portion of the computing system 100 of FIGS. 8 and 9, having the electronic plug 102 connected to the electronic port 104 and retained in a locked stage within the electronic port 104. The electronic plug 102, for example, the USB plug 102A is slidably inserted into the electronic port 104, for example, the USB port 104A until the first recess 134 is aligned with the second recess 204. As the first recess 134 is aligned with the second recess 204, the deformable arm 142 moves back to the relaxed position, causing the cantilever beam 140 to straighten up in order to protrude the locking tab 158 above the first recess 134 and the second recess 204. The locking tab 158 protruded above the first recess 134 and the second recess 204 prevents movement of the connector 106 out of the receptacle 116. Thus, retaining the USB plug 102A in the locked stage within the USB port 104A. In such examples, the movement of the deformable arm 142 to the relaxed state may cause the axle 138 to rotate along a second direction 150 opposite to the first direction 148, thus resulting in transitioning the actuator 112 to the second position 232. It may be noted herein that the second position 232 may be representative of the locked stage of the USB plug 102A.

Referring to FIGS. 8-10, in some examples, a non-conventional shaped driver (not shown) having a unique shaped complementary groove head (for example, Torx T8H shaped complementary groove head), may fit-in to a unique shaped groove head 188 (shown in FIG. 5) of the actuator 112 in order to transition the actuator 112 to the first position 234 before plugging the USB plug 102A into the USB port 104A. In such examples, transitioning of the actuator 112 to the first position 234 by the non-conventional shaped driver, may cause the axle 138 to rotate along the first direction 148, the deformable arm 142 to move to the biased state, and the cantilever beam 140 to bend downwards along the vertical plane 156, in order to position the locking tab 158 below the first recess 134 and/or the second recess 204. Thus, allowing movement of the connector 106 in and out of the receptacle 116.

Similarly, the actuator 112 may be transitioned back to the second position 232 by using the non-conventional shaped driver, as discussed herein. In such examples, transitioning of the actuator 112 back to the second position 232 may cause the axle 138 to rotate along the second direction 150 opposite to the first direction 148, the deformable arm 142 to move to the relaxed state, and the cantilever beam 140 to straighten up along the vertical plane 156, in order to protrude the locking tab 158 above the first recess 134 and/or the second recess 204. Thus, preventing movement of the connector 106 out of the receptacle 116.

In one or more examples, the actuator 112 having the unique shaped groove head 188 may deter fitting-in of a conventional shaped driver (not shown) into the unique shaped groove head 188 for rotating the axle 138 along the first direction 148 and/or the second direction 150. Thus, preventing an unauthorized user to plug-out the USB plug 102A from the USB port 104A. As used herein, the term "unauthorized user" may refer to a common user, who typically do not have possession of the non-conventional shaped driver. As used herein, the term "conventional shaped driver" may refer to a commonly available driver having one of a star groove head, cross grove head, slot groove head, or the like. As used herein, the term "non-conventional shaped driver" may refer to a rarely available driver having Torx T8H shaped complementary groove head, for example.

Figure 11:
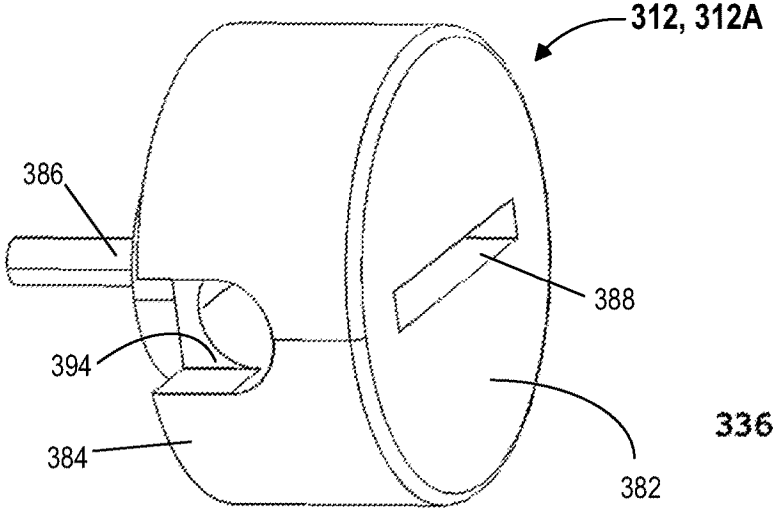
FIG. 11 illustrates an isometric view of an actuator according to another example implementation of the present disclosure.

FIG. 11 depicts an isometric view of an actuator 312 according to another example implementation of the present disclosure. The actuator 312 is a knob 312A. In some examples, the knob 312A has a knob head 382, a knob body 384 having a second hole 394, and a spindle 386 extending through the knob head 382 and knob body 384. The knob head 382 has a conventional shaped groove head 388, for example, a slot groove head. The spindle 386 may have a plurality of complementary spines (not shown) to that of the plurality of splines of the axle 138 (shown in FIGS. 1A, 1B, and 3), so as to allow the knob 312A to be press-fitted to the axle 138.

Figure 12:
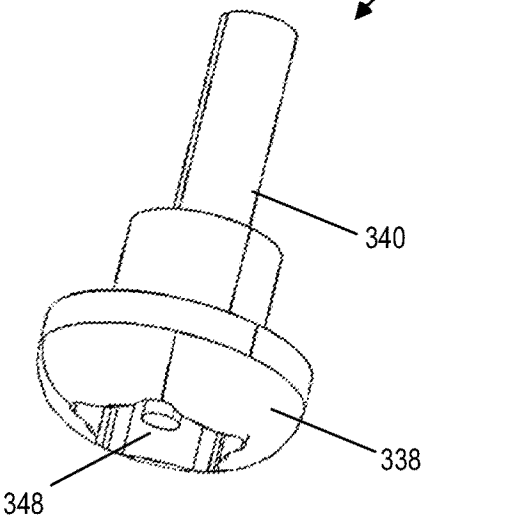
FIG. 12 illustrates an isometric view of a fastener according to another example implementation of the present disclosure.

FIG. 12 depicts an isometric view of a fastener 336 according to another example implementation of the present disclosure. The fastener 336 is a captive screw, for example, which includes a screw head 338 and screw body 340 connected to the screw head 338. In some examples, the screw head 338 has a unique shaped groove head 348. For example, in the illustrated example of FIG. 12, the unique shaped groove head 348 is Torx T8H shaped groove head.

Figure 13:
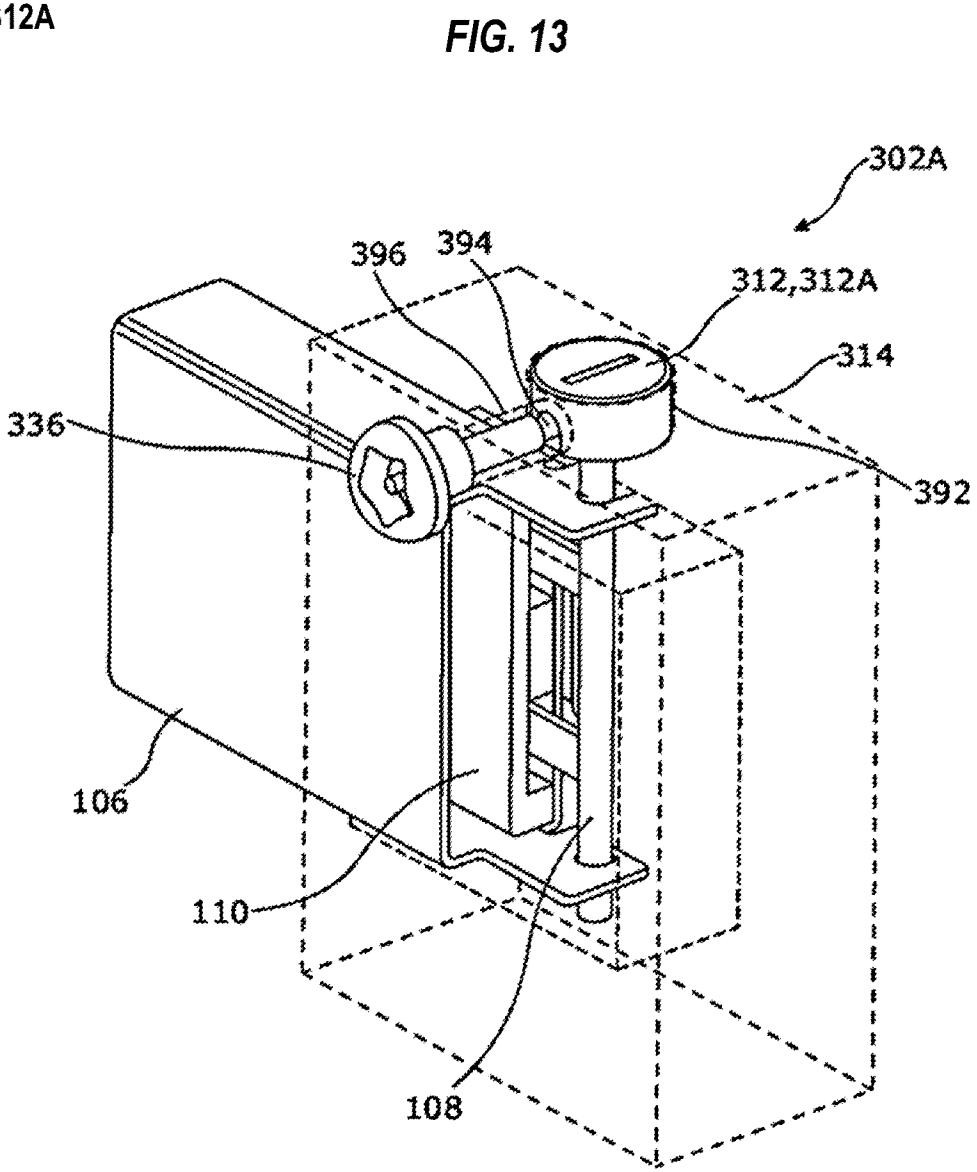
FIG. 13 illustrates an isometric view of an electronic plug having the actuator of FIG. 11 and the fastener of FIG. 12 according to another example implementation of the present disclosure.

FIG. 13 depicts an isometric view of an electronic plug 302, for example, an USB plug 302A having the actuator 312 of FIG. 11, the fastener 336 of FIG. 12, and a plug body 314. In some examples, the electronic plug 302 may include a connector 106, a locking assembly 108, and an insulator 110, as discussed herein in the example of FIGS. 1A, 1B, and 2-6 without deviating from the scope of the present disclosure. The plug body 314 includes a first hole 392 formed on one of the peripheral walls of the plug body 314, and a third hole 396 formed on one of a base or a cover of the plug body 314. In some examples, the third hole 396 is aligned at an angle relative to the first hole 392. For example, the third hole 396 is aligned perpendicular to the first hole 392. In some examples, the knob 312A is disposed within the first hole 392 of the plug body 314 such that the spindle 386 of the knob 312A gets coupled (press-fitted) to the axle 138. In such examples, the second hole 394 in the knob 312A is aligned with the third hole 396 of the plug body 314. Later, the fastener 336 is fastened into the third hole 396 and the second hole 394 to restrict the knob 312A to rotate the axle 138 along a first direction 148 and/or a second direction 150 (shown in FIGS. 8-10). In one or more examples, the fastener 336 having the unique shaped groove head 348 may deter fitting-in of a conventional shaped driver (not shown) into the unique shaped groove head 348 for rotating the axle 138 via the knob 312A, along the first direction 148 and/or the second direction 150. Thus, preventing an unauthorized user to plug-out the USB plug 302A from a USB port. In some examples, if the fastener 336 is not fastened into the third hole 396, the unauthorized user and/or the authorized user may use a conventional shaped driver to move the knob 312A to a first position 234 (as shown in FIG. 9) to remove the USB plug 302A from the USB port.

Figure 14:
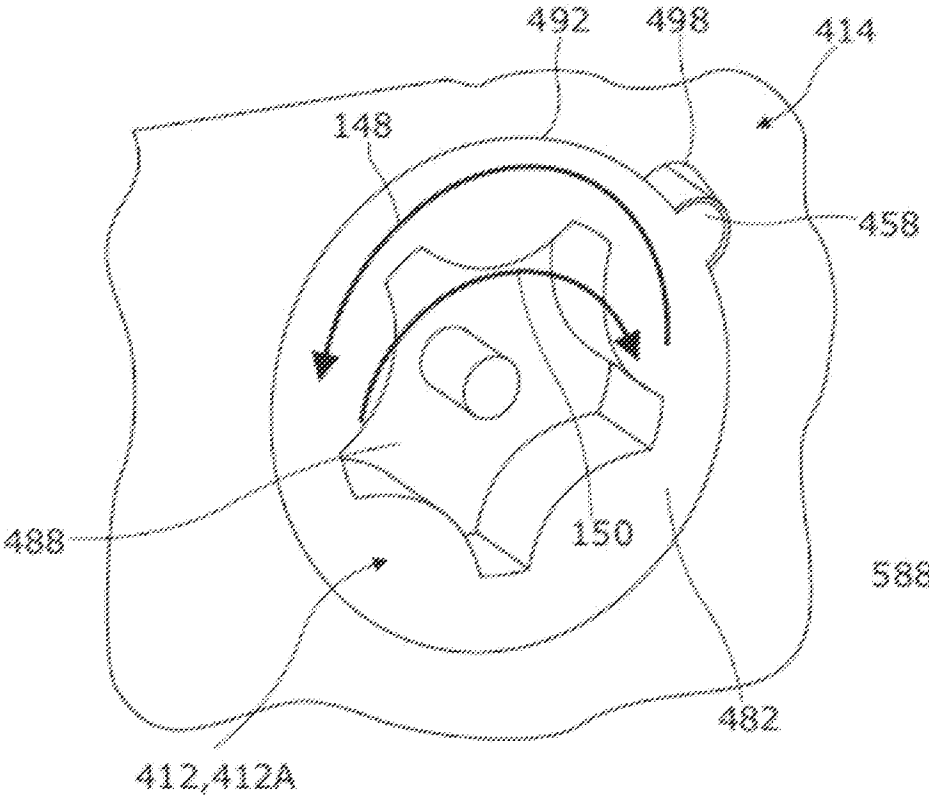
FIG. 14 illustrates a block diagram of a portion of an actuator and a plug body according to another example implementation of the present disclosure.

FIG. 14 depicts a block diagram of a portion of an actuator 412 and a plug body 414 according to another example implementation of the present disclosure. The actuator 412 is a knob 412A having a knob head 482, a knob body (not shown), and a spindle (not shown) extending through the knob head 482 and the knob body. The knob head 482 has a unique shaped groove head 488, for example, Torx T8H shaped groove head, as shown in FIG. 5. The knob head 482 further includes a protrusion 458, for example, a curved shaped protrusion. The plug body 414 includes a first hole 492 and an aperture 498, for example a curved shaped aperture connected to the first hole 492, having a length substantially equal to a length of the protrusion 458 in the knob head 482. Further, the aperture 498 has a radius substantially greater than the radius of the protrusion 458. In such examples, the knob 412A is disposed within the first hole 492 of the plug body 414 such that the spindle of the knob 412A gets coupled (press-fitted) to the axle 138 (as shown in FIG. 3) and the protrusion 458 is positioned in the aperture 498. In some examples, a non-conventional shaped driver (not shown) having a unique shaped complementary groove head (for example, Torx T8H shaped complementary groove head), may fit-in to the unique shaped groove head 488 of the knob 412A in order to rotate an axle 138 (shown in FIG. 3) along a first direction 148 to transition a USB plug into an unlocked stage, and/or a second direction 150 to transition the USB plug into a locked stage. In such examples, the aperture 498 and the protrusion 458 may restrict over rotation of the axle 138 by the knob 412A along the second direction 150 in order to prevent a deformable arm 142 (shown in FIG. 3) to get dislodged from a connector 106 (shown in FIG. 2). Similarly, the aperture 498 and the protrusion 458 may restrict over rotation of the axle 138 by the knob 412A along the first direction 148 in order to prevent over stretching of the deformable arm 142.

Figure 15:
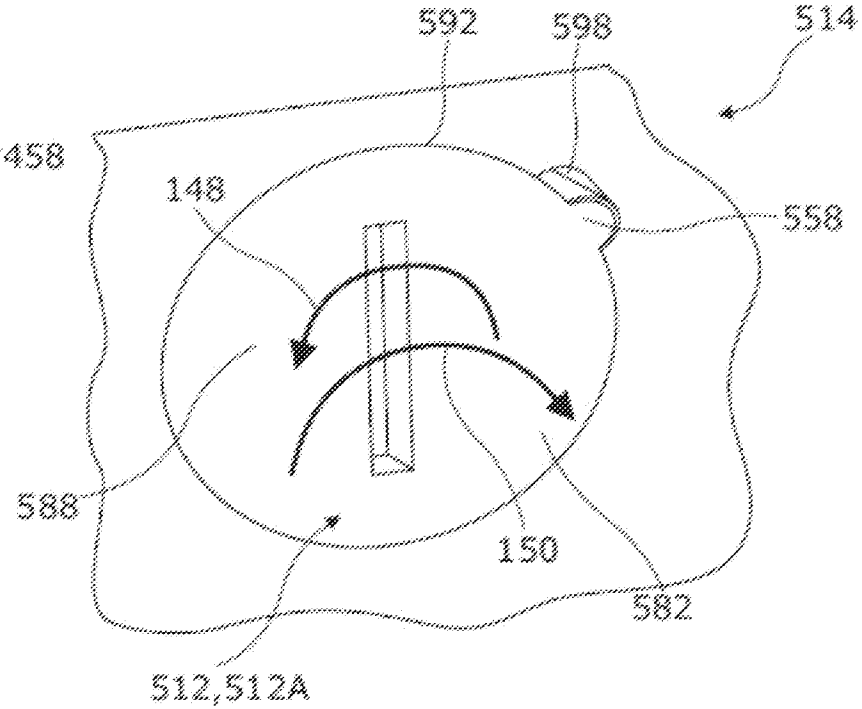
FIG. 15 illustrates a block diagram of a portion of an actuator and a plug body according to yet another example implementation of the present disclosure.

FIG. 15 depicts a block diagram of a portion of an actuator 512 and a plug body 514 according to yet another example implementation of the present disclosure. The actuator 512 is a knob 512A having a knob head 582, a body (not shown), and a spindle (not shown) extending through the knob head 582 and the knob body. The knob head 582 has a conventional shaped groove head 588, for example, cut shaped groove head, as shown in FIG. 11. The knob head 582 further includes a protrusion 558, for example, a curved shaped protrusion. The plug body 514 includes a first hole 592 and an aperture 598, for example a curved shaped aperture connected to the first hole 592, having a length substantially equal to a length of the protrusion 558 in the knob head 582. Further, the aperture 598 has a radius substantially greater than the radius of the protrusion 558. In such examples, the knob 512A is disposed within the first hole 592 of the plug body 514 such that the spindle of the knob 512A gets coupled (press-fitted) to the axle 138 (as shown in FIG. 3) and the protrusion 558 is positioned in the aperture 598. In some examples, a conventional shaped driver (not shown) having a cut-shaped complementary groove head may fit-in to the conventional shaped groove head 588 of the knob 512A in order to rotate an axle 138 (shown in FIG. 3) along a first direction 148 to transition a USB plug into an unlocked stage, and/or a second direction 150 to transition the USB plug into a locked stage. In such examples, the aperture 598 and the protrusion 558 may restrict over rotation of the axle 138 by the knob 512A along the second direction 150 in order to prevent a deformable arm 142 (shown in FIG. 3) to get dislodged from a connector 106 (shown in FIG. 2). Similarly, the aperture 598 and the protrusion 558 may restrict over rotation of the axle 138 by the knob 512A along the first direction 148 in order to prevent over stretching of the deformable arm 142.

Figure 16:
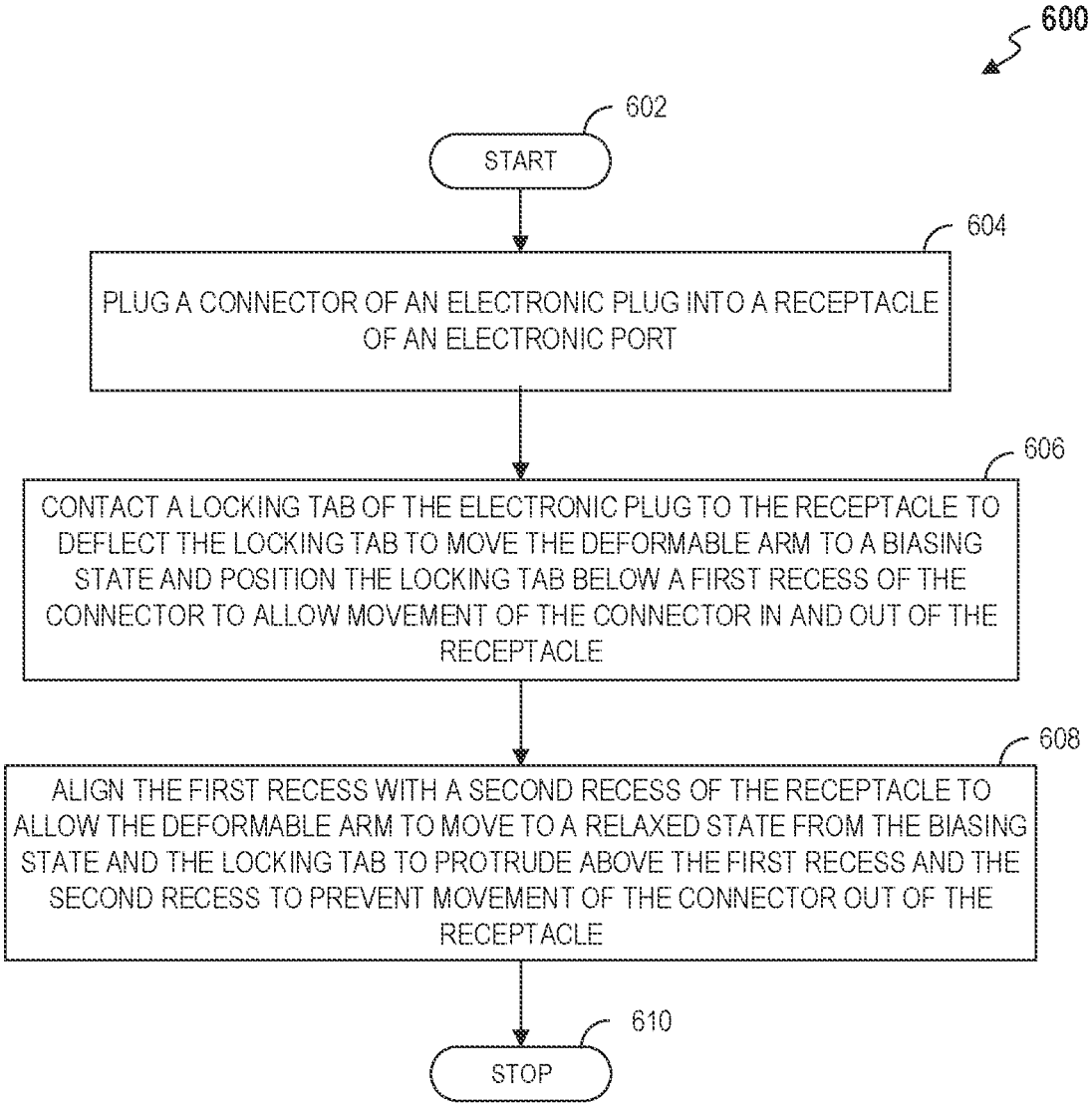
FIG. 16 is a flow diagram depicting a method of locking an electronic plug within an electronic port of a computing system according to an example implementation of the present disclosure.

FIG. 16 is a flow diagram depicting a method 600 of locking an electronic plug within an electronic port of a computing system. It should be noted herein that the method 600 is described in conjunction with FIGS. 1A, 1B, and 2-10.

The method 600 starts at block 602 and continues to block 604. At block 604, the method 600 includes plugging a connector of the electronic plug to a receptacle of the electronic port. In some examples, the connector of the electronic plug is pushed inside (slidably inserted into) a cut-out in an enclosure of a computing system in order to connect/attach the connector of the electronic plug into the receptacle of the electronic port. The method 600 moves to block 606. In some examples, the electronic plug is a USB plug and the electronic port is a USB port. In some examples, the connector has a first recess and the receptacle has a second recess. The electronic plug further includes a locking assembly having an axle, a cantilever beam, and a deformable arm. The axle is rotatably coupled to the connector. The cantilever beam extends from the axle, where a free end of the cantilever beam includes a locking tab aligned with the first recess. The deformable arm extends from the axle, where an open end of the deformable arm is rested on the connector.

At block 606, the method 600 includes contacting the locking tab to the receptacle to deflect the locking tab to move the deformable arm to a biasing state and position the locking tab below the first recess to allow movement of the connector in and out of the receptacle. In some examples, the locking assembly having the locking tab positioned below the first recess may be representative of an unlocked stage of the electronic plug. The method 600 moves to block 608.

At block 608, the method 600 includes aligning the first recess with the second recess to allow the deformable arm to move to a relaxed state from the biasing state, and the locking tab to protrude above the first recess and the second recess to prevent movement of the connector out of the receptacle. In some examples, the locking assembly having the locking tab protruded above the first recess and the second recess may be representative of a locked stage of the electronic plug.

In some examples, the method 600 may further includes the step of using an actuator to rotate the axle along a first direction to move the deformable arm to the biased state. In such examples, the cantilever beam bends down to position the locking tab below the first recess and/or the second recess. Similarly, the method includes the step of using the actuator to rotate the axle along a second direction opposite to the first direction, to move the deformable arm to the relaxed state. In such examples, the cantilever beam straightens up to protrude the locking tab above the first recess and/or the second recess. The method 600 ends at block 610.

Various features as illustrated in the examples described herein may be implemented in a system, such as an electronic plug. In particular, the electronic plug may have a locking assembly (or a security assembly) to prevent unauthorized removal of the electronic plug from the computing system. The locking assembly may include components, which are internal to the electronic plug, which occupies a substantially little space due to its integration with one or more standardized components of the electronic plug, and which are of a miniaturized nature in design. The locking assembly of the present disclosure has a simple design, which may allow the cost to be substantially low. Further, the locking assembly disclosed herein is self-contained and does not use additional components external to the electronic plug for locking or unlocking purpose of the electronic plug.

In the foregoing description, numerous details are set forth to provide an understanding of the subject matter disclosed herein. However, implementation may be practiced without some or all of these details. Other implementations may include modifications, combinations, and variations from the details discussed above. It is intended that the following claims cover such modifications and variations.

What is claimed is:

1. An electronic plug comprising:

a connector having a first recess; and a locking assembly comprising;

an axle rotatably coupled to the connector;

a cantilever beam extending from the axle, wherein a free end of the cantilever beam comprises a locking tab aligned with the first recess; and a deformable arm extending from the axle, wherein an open end of the deformable arm is rested on the connector, wherein, in a biased state of the deformable arm, the locking tab is positioned below the first recess to allow movement of the connector in and out of a receptacle of an electronic port, and wherein, in a relaxed state of the deformable arm, the locking tab protrudes above the first recess to allow movement of the connector into the receptacle and prevent movement of the connector out of the receptacle.

2. The electronic plug of claim 1, wherein the axle, the cantilever beam, and the deformable arm are integrated to one another to form a unitary locking component.

3. The electronic plug of claim 1, further comprising an insulator disposed within the connector and coupled to at least one inner surface of the connector, and wherein the insulator has an elongated opening to allow the cantilever beam to bend down, straighten up, and extend from the axle, and the locking tab to protrude above and position below the first recess.

4. The electronic plug of claim 1, wherein the locking tab is oriented at an acute angle relative to the cantilever beam for allowing the locking tab to deflect upon contacting the receptacle to bend down the cantilever beam for positioning the locking tab below the first recess.

5. The electronic plug of claim 1, further comprising an actuator, and a plug body housing a portion of the locking assembly and the connector, wherein the plug body has a first hole aligned with the axle, wherein the actuator is disposed within the first hole and coupled to the axle, wherein the actuator is configured to rotate the axle along a first direction to move the deformable arm to the biased state, and wherein the actuator is further configured to rotate the axle along a second direction opposite to the first direction, to move the deformable arm to the relaxed state.

6. The electronic plug of claim 5, wherein the actuator has a Torx shaped groove head.

7. The electronic plug of claim 5, further comprising a fastener having a Torx shaped groove head, wherein the actuator has a groove head and a body having a second hole, wherein the plug body further has a third hole aligned at an angle relative to the first hole, wherein the second hole is aligned with the third hole, when the actuator is disposed within the first hole of the plug body, and wherein the fastener is fastened into the second hole and the third hole to restrict the actuator to rotate the axle.

8. The electronic plug of claim 5, wherein the plug body further has an aperture connected to the first hole, wherein the actuator comprises a protrusion disposed within the aperture, wherein the aperture and the protrusion restrict over rotation of the axle by the actuator.

9. The electronic plug of claim 1, wherein the first recess is aligned with a second recess of the receptacle to allow the deformable arm to move to the relaxed state from the biased state, and the locking tab to protrude above the first recess and the second recess to prevent movement of the connector out of the receptacle.

10. A computing system comprising:

an enclosure;

an electronic plug comprising a connector having a first recess and a locking assembly comprising:

an axle rotatably coupled to the connector;

a cantilever beam extending from the axle, wherein a free end of the cantilever beam comprises a locking tab aligned with the first recess; and a deformable arm extending from the axle, wherein an open end of the deformable arm is rested on the connector; and an electronic port disposed within the enclosure, comprising a receptacle having a second recess, wherein electronic plug is detachably coupled to the electronic port via the enclosure, wherein, in a biased state of the deformable arm, the locking tab is positioned below the first recess to allow movement of the connector in and out of the receptacle, and wherein, in a relaxed state of the deformable arm, the locking tab protrudes above the first recess to allow movement of the connector into the receptacle and prevent movement of the connector out of the receptacle.

11. The computing system of claim 10, wherein the axle, the cantilever beam, and the deformable arm are integrated to one another to form a unitary locking component.

12. The computing system of claim 10, wherein the electronic plug further comprises an insulator disposed within the connector and coupled to at least one inner surface of the connector, and wherein the insulator has an elongated opening to allow the cantilever beam to bend down, straighten up, and extend from the axle, and the locking tab to protrude above and position below the first recess and/or the second recess.

13. The computing system of claim 10, wherein the locking tab is oriented at an acute angle relative to the cantilever beam for allowing the locking tab to deflect upon contacting the receptacle to bend down the cantilever beam for positioning the locking tab below the first recess.

14. The computing system of claim 10, wherein the electronic plug further comprises an actuator, and a plug body housing a portion of the locking assembly and the connector, wherein the plug body has a first hole aligned with the axle, wherein the actuator is disposed within the first hole and coupled to the axle, wherein the actuator is configured to rotate the axle along a first direction to move the deformable arm to the biased state, and wherein the actuator is further configured to rotate the axle along a second direction opposite to the first direction, to move the deformable arm to the relaxed state.

15. The computing system of claim 14, wherein the actuator has a Torx shaped groove head.

16. The computing system of claim 14, wherein the electronic plug further comprises a fastener having a Torx shaped groove head, wherein the actuator has a groove head and a body having a second hole, wherein the plug body further has a third hole aligned at an angle relative to the first hole, wherein the second hole is aligned with the third hole, when the actuator is disposed within the first hole of the plug body, and wherein the fastener is fastened into the second hole and the third hole to restrict the actuator to rotate the axle.

17. The computing system of claim 14, wherein the plug body further has an aperture connected to the first hole, wherein the actuator comprises a protrusion disposed within the aperture, wherein the aperture and the protrusion restrict over rotation of the axle by the actuator.

18. The computing system of claim 10, wherein the first recess is aligned with the second recess to allow the deformable arm to move to the relaxed state from the biased state, and the locking tab to protrude above the first recess and the second recess to prevent movement of the connector out of the receptacle.

19. A method comprising:

plugging a connector of an electronic plug into a receptacle of an electronic port, wherein the connector has a first recess and the receptacle has a second recess, wherein the electronic plug comprises a locking assembly comprising:

an axle rotatably coupled to the connector;

a cantilever beam extending from the axle, wherein a free end of the cantilever beam comprises a locking tab aligned with the first recess; and a deformable arm extending from the axle, wherein an open end of the deformable arm is rested on the connector; and contacting the locking tab to the receptacle to deflect the locking tab to move the deformable arm to a biasing state and position the locking tab below the first recess to allow movement of the connector in and out of the receptacle; and aligning the first recess with the second recess to allow the deformable arm to move to a relaxed state from the biasing state, and the locking tab to protrude above the first recess and the second recess to prevent movement of the connector out of the receptacle.

20. The method of claim 19, further comprising a) rotating the axle along a first direction to move the deformable arm to the biased state and the cantilever beam to bend down to position the locking tab below the first recess and/or the second recess, or b) rotating the axle along a second direction opposite to the first direction, to move the deformable arm to the relaxed state and the cantilever beam to straighten up to protrude the locking tab above the first recess and the second recess.

* * * * *